US011619474B2

(12) United States Patent
Frederick et al.

(10) Patent No.: US 11,619,474 B2
(45) Date of Patent: Apr. 4, 2023

(54) TARGETING SYSTEMS AND METHODS

(71) Applicant: THE BOEING COMPANY, Chicago, IL (US)

(72) Inventors: Madison L. Frederick, Huntsville, AL (US); Hayden Gregory Martin, Madison, AL (US); Nicholas Martin Wyckoff, Huntsville, AL (US)

(73) Assignee: THE BOEING COMPANY, Chicago, IL (US)

( * ) Notice: Subject to any disclaimer, the term of this patent is extended or adjusted under 35 U.S.C. 154(b) by 53 days.

(21) Appl. No.: 17/323,157

(22) Filed: May 18, 2021

(65) Prior Publication Data

US 2022/0049940 A1 Feb. 17, 2022

Related U.S. Application Data

(60) Provisional application No. 63/066,349, filed on Aug. 17, 2020.

(51) Int. Cl.
*F42B 12/40* (2006.01)
*F42B 12/36* (2006.01)

(52) U.S. Cl.
CPC ..... *F42B 12/40* (2013.01); *F42B 12/365* (2013.01)

(58) Field of Classification Search
None
See application file for complete search history.

(56) References Cited

U.S. PATENT DOCUMENTS 3,712,229 A * 1/1973 Schock ..... F42B 12/58 102/489
3,935,817 A * 2/1976 Riparbelli ..... F42B 12/06 102/374
4,281,809 A * 8/1981 Oglesby ..... F42B 12/40 244/3.14
4,448,106 A * 5/1984 Knapp ..... F42B 12/40 367/1
4,867,034 A * 9/1989 Trosky ..... F42B 12/382 102/513
5,461,982 A * 10/1995 Boyer, III ..... F42B 12/40 102/513
6,311,623 B1 * 11/2001 Zaruba ..... F42B 6/04 102/371
6,453,790 B1 * 9/2002 Cesulka ..... F42B 12/365 102/293
7,300,367 B1 * 11/2007 Andol ..... F42B 6/04 473/578
7,331,887 B1 * 2/2008 Dunn ..... F42B 12/385 473/578
7,503,521 B2 * 3/2009 Maynard ..... F42B 12/365 244/3.13
7,845,283 B2 * 12/2010 Finneral ..... F41H 13/00 102/386
8,055,206 B1 * 11/2011 Bass ..... H04K 3/41 455/39

(Continued)

*Primary Examiner* — Derrick R Morgan
(74) *Attorney, Agent, or Firm* — The Small Patent Law Group LLC; Joseph M. Butscher

(57) ABSTRACT

A targeting munition for a targeting system and method includes a payload including a plurality of shards. At least one of the shards includes a laser diode configured to emit targeting emission in response to the targeting munition impacting an area at or proximate to a target.

20 Claims, 6 Drawing Sheets

(56) References Cited

U.S. PATENT DOCUMENTS

| | | | | |
|---|---|---|---|---|
| 8,412,048 | B2 * | 4/2013 | Dunlap | H04B 10/11 367/133 |
| 8,764,590 | B2 * | 7/2014 | Draper | F42B 12/362 473/578 |
| 9,749,789 | B1 * | 8/2017 | Edmonds | H04W 4/023 |
| 10,514,240 | B1 * | 12/2019 | Despain | F42B 12/58 |
| 2011/0179963 | A1 * | 7/2011 | Tepera | F42B 12/60 102/506 |
| 2013/0023364 | A1 * | 1/2013 | Draper | F42B 12/362 473/570 |
| 2017/0357002 | A1 * | 12/2017 | Winker | F41J 5/00 |
| 2020/0284566 | A1 * | 9/2020 | Viviani | B64D 7/00 |

* cited by examiner

TARGETING SYSTEMS AND METHODS

CROSS-REFERENCE TO RELATED APPLICATIONS

This application relates to and claims priority benefits from U.S. Provisional Application No. 63/066,349, entitled "Targeting Systems and Methods," filed Aug. 17, 2020, which is hereby incorporated by reference in its entirety.

FIELD OF THE DISCLOSURE

Embodiments of the present disclosure generally relate to targeting systems and methods, such as may be used to provide targeting designations for military air strikes.

BACKGROUND OF THE DISCLOSURE

During certain military operations, ground forces are used to provide guidance to aircraft, for example, with respect to a particular target. As an example, ground forces can use joint direct attack munitions (JDAM) targeting concept of operations (CONOPS) to coordinate with aircraft with respect to a particular target.

Targeting for laser JDAMs is provided via hand-held designators, sniper pods, or litening pods. Typically, the pods require an aircraft to locate a target, designate the target, achieve a target lock, and engage with a laser-guided munition, thereby exposing the aircraft for an extended time over the target, which increases risk to the aircraft. Further, ground operators typically continuously laze the target, remaining exposed to ground fire, thereby also exposing themselves to risk.

SUMMARY OF THE DISCLOSURE

A need exists for a targeting system and method that reduces a risk profile for strike aircraft. Further, a need exists for a targeting system and method that do not require a ground fire coordinator to maintain a targeting emission (such as an illumination) on a target. Further, a need exists for a targeting system and method that minimize or otherwise reduce aircraft exposure to ground fire while the aircraft drops munitions on a target.

With those needs in mind, certain embodiments of the present disclosure provide a targeting munition for a targeting system. The targeting munition includes a payload including a plurality of shards. At least one of the shards includes a laser diode configured to emit targeting emission in response to the targeting munition impacting an area at or proximate to a target. In at least one embodiment, each of the plurality of shards includes a laser diode.

In at least one embodiment, the laser diode is configured to emit the targeting emission at a predetermined frequency.

In at least one example, the payload further comprises a battery and a ballast.

In at least one example, the targeting munition further includes a propulsion system coupled to the payload.

As an example, the targeting munition is a 40 mm targeting grenade.

In at least one embodiment, the payload further includes a retention band to retain the plurality of shards prior to the targeting munition impacting the target. As a further example, a band cutter is configured to sever the retention band in response to the targeting munition impacting the target.

In at least one embodiment, each of the plurality of shards is configured to be ejected a predetermined distance in response to the targeting munition impacting the target. For example, the predetermined distance is approximately 1 to 3 meters.

In at least one embodiment, the plurality of shards comprises five shards.

In at least one example, at least one of the plurality of shards is configured to land in an upright position such that the laser diode emits the targeting emission toward the sky.

Certain embodiments of the present disclosure provide a targeting method including directing a targeting munition toward a target, and emitting targeting emissions from laser diodes of a plurality of shards ejected from the targeting munition upon impact of the targeting munition at or proximate to the target.

DETAILED DESCRIPTION OF THE DISCLOSURE

Figure 1:
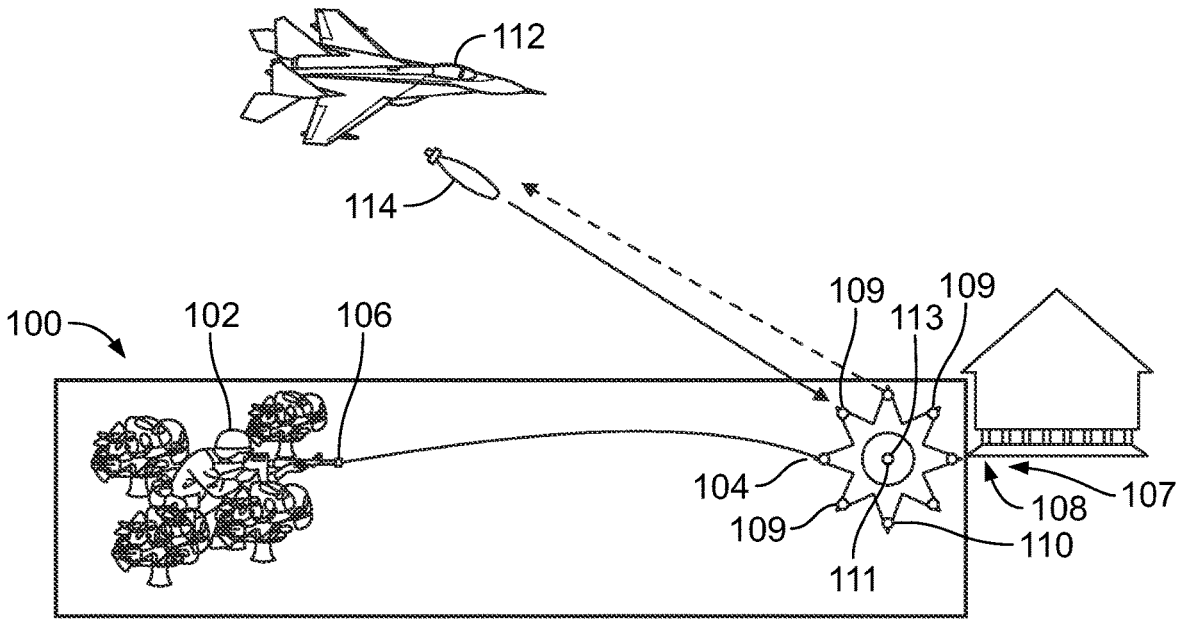
FIG. 1 illustrates a schematic diagram of a targeting system, according to an embodiment of the present disclosure.

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition can include additional elements not having that condition.

Certain embodiments of the present disclosure provide a targeting munition (such as a 40 mm grenade) that is configured to provide targeting designation for air strikes using JDAMS, small diameter bombs (SDBs), and airborne gunnery (for example, gunnery of AC-130, A-10, Rotorcraft, or the like). In at least one embodiment, the munition is deployed using a standard 40 mm grenade launcher, strikes the target area and breaks into pieces, such that each piece emits infrared (IR) illumination at a classified frequency for a user defined duration. The IR illumination paints or otherwise clearly designates the target area for strike aircraft and provides terminal guidance for munitions deployed from the aircraft.

Certain embodiments of the present disclosure provide a targeting system and method that allows for fire and forget laser JDAM and SDB targeting. The targeting system and method does not require an operator to continuously target an intended impact point, thereby enabling the operator to dispense the targeting munition and leave the area. The targeting system and method enables indirect targeting when an operator does not have line of sight on the target (for example, the munition can be lobbed over an obstruction).

Embodiments of the present disclosure provide targeting systems and methods that reduce the possibility of detection of an operator who dispensed the munition. For example, it is much more difficult to spot a muzzle flash of a 40 mm grenade launcher than a laser that is continually trained on a target.

Further, embodiments of the present disclosure allow for reduced training required to utilize the systems and methods described herein, thereby being readily available to an increased number of potential operators. Further, embodiments of the present disclosure reduce required support equipment to dispense a JDAM, reduce the time a strike aircraft is exposed to ground fire, and reduce the exposure time for an operator on the ground. Further, the munition is not susceptible to environmental conditions between an operator initiating the target and the target (for example, the operator can fire the munition through rain and snow and the illuminated target still produces targeting emission).

Certain embodiments of the present disclosure provide a targeting munition for a targeting system. The targeting munition includes a propulsion system, and a payload coupled to the propulsion system. The payload includes a plurality of shards (such as five or more shards). In at least one embodiment, each shard includes a battery, a laser diode and a ballast. Each shard is configured to emit targeting emissions at a predetermined frequency. In at least one embodiment, the targeting munition is a 40 mm targeting grenade. In at least one embodiment, a code-loading device may be used to load a frequency code into the targeting munition prior to deployment, thereby enabling the predetermined frequency.

In at least one embodiment, the payload further includes a retention band to retain the plurality of shards prior to impact. Further, a band cutter is configured to sever the retention band on impact.

In at least one embodiment, upon impact, each of the shards is configured to be ejected a predetermined distance. For example, the predetermined distance is approximately (for example, +/−0.2 meters) 1 to 3 meters.

In at least one embodiment, after ejection, at least one of the shards is configured to land in an upright position such that the laser diode emits illuminating light toward the sky.

Certain embodiments of the present disclosure provide a targeting munition including a propulsion system, and a payload coupled to the propulsion system. The payload includes a plurality of shards. Each shard includes a battery, an illumination device, and a ballast. Each shard is configured to illuminate a predetermined target at an infrared frequency.

FIG. 1 illustrates a schematic diagram of a targeting system 100, according to an embodiment of the present disclosure. In at least one embodiment, an operator 102 (for example, a soldier on the ground) dispenses (for example, fires) a targeting munition 104 (such as 40 mm grenade) from a portable grenade launcher 106 toward a target 108. The targeting munition 104 impacts an area 107 of and/or proximate to (such as within 20 meters) the target 108 and separates into pieces 109 (for example, shards). Each piece 109 emits targeting emissions 110, such as infrared illumination. The pieces 109 spread around the point of impact 111, providing a radius of point source 113 targeting light. Incoming strike aircraft 112 detect the targeting emissions 110, and process to target the targeting emissions 110. Upon or response to targeting, the strike aircraft 112 release, fire, or otherwise direct a munition 114, such as a JDAM or SDM, which seeks and destroys the targeting munition 104, and also the target 108, where or proximately where the targeting munition 104 is located.

In at least one embodiment, the targeting system 100 utilizes a single aircraft (for example, the aircraft 112). Further, the aircraft 112 acquires the target 108 in a short period of time, directs the munition 114 at the targeting emissions 110, and exits the area surrounding the target 108. The targeting system 100 also does not require additional action from the operator 102 after the targeting munition 104 is fired. Accordingly, the operator 102 is able to leave the scene after firing the targeting munition 104. Further, the targeting system 100 does not require specialized training for the operator 102, who is likely already trained in grenade launchers. Also, the targeting system 100 reduces the logistics footprint for targeting and weight carried by the operators. Multiple targeting munitions 104 can be used at once to allow for multiple JDAM/SDBs to be dropped on multiple targets 108.

As shown in FIG. 1, the operator 102 fires the targeting munition 104 toward the target 108. The targeting munition 104 explodes and separates at or proximate to the target 108, and emits the targeting emissions 110, such as IR emissions suitable for laser JDAM/SBD targeting. The aircraft 112 arrives and detects the targeting emissions 110. The aircraft 112 then directs (for example, fires or drops) the munition 114 (such as a JDAM or SBD) at the targeting emissions 110, thereby destroying the target 108 and remaining portions of the targeting munition 104. In at least one embodiment, remaining portions of the targeting munition 104 self-destruct, such as when a battery reaches a termination threshold.

The targeting system 100: (1) allows for fire and forget Laser JDAM and SDB targeting, (2) does not require the operator 102 to continuously target the intended impact point, (3) enables the operator 102 to dispense the targeting munition and leave the area, (4) enables indirect targeting when the operator 102 does not have line of sight on the target (lobbed or otherwise arced over an obstruction), (5) reduces the potential of detection of the operator 102, (6) is disposable, (7) allows for reduced training required to utilize, and is therefore more available to full forces, (8) reduces the need for required support aircraft to dispense a JDAM, (9) reduces the time a strike aircraft is exposed to ground fire, (10) reduces the time a soldier on the ground is exposed during the strike, and (11) is not (or is less) susceptible to environmental conditions between the operator 102 initiating the target 108 and the target 108 itself (for example, the operator 102 is able to fire the targeting munition 104 through rain and snow and the illuminated target still produces necessary targeting emission).

Figure 2:
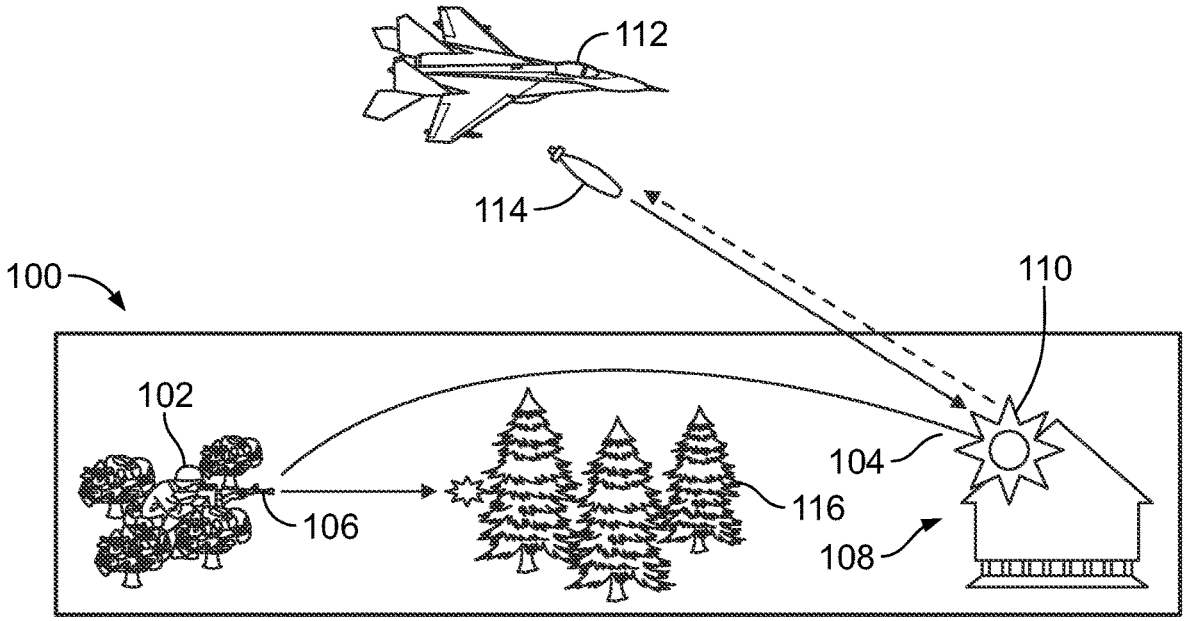
FIG. 2 illustrates a schematic diagram of the targeting system.

FIG. 2 illustrates a schematic diagram of the targeting system 100. As shown, the targeting system 100 can be used even when the sight line to the target 108 is obstructed. For example, the targeting munition 104 can be fired over (for example, lobbed or arced over) the obstruction 116.

Figure 3:
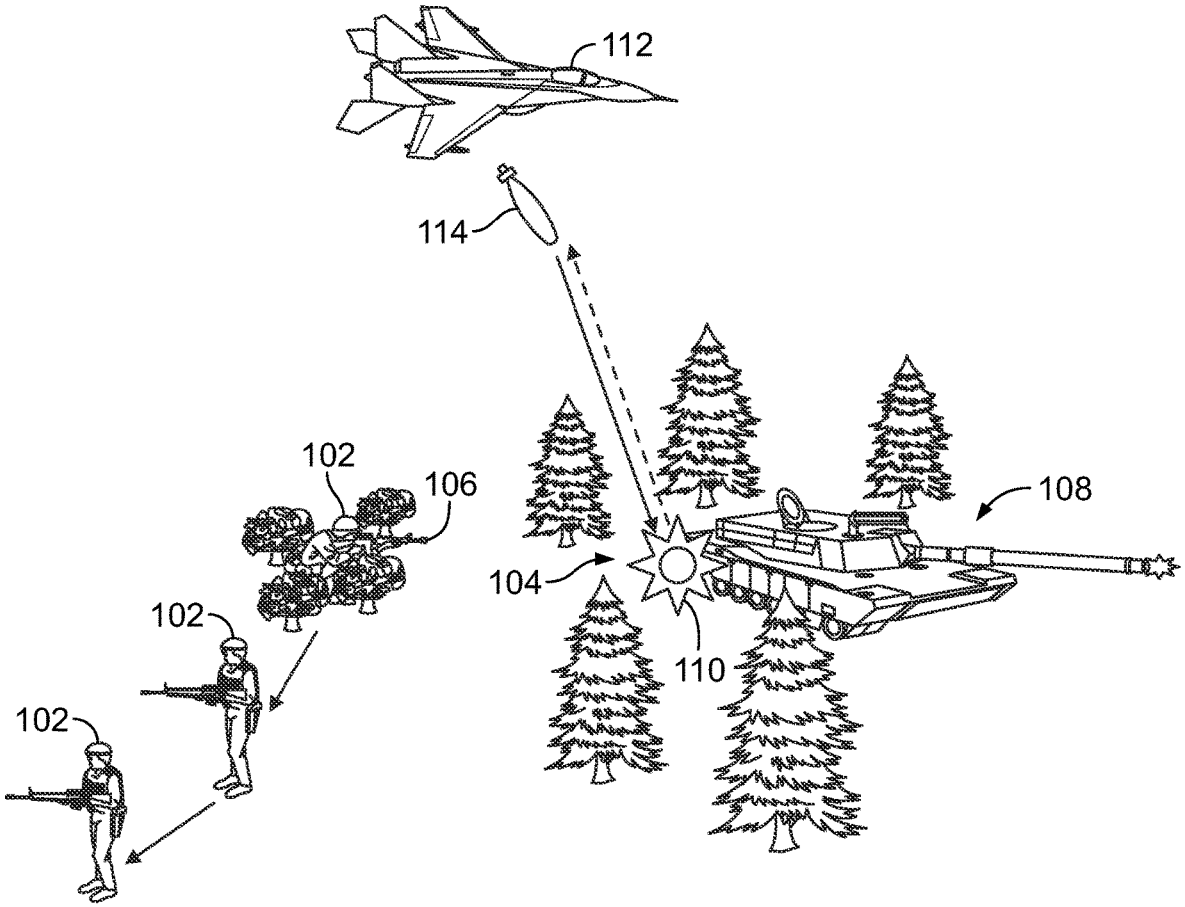
FIG. 3 illustrates a schematic diagram of the targeting system.

FIG. 3 illustrates a schematic diagram of the targeting system 100. As shown, after the operator 102 fires the targeting munition 104, the operator 102 can relocate, such as to an area of cover.

Figure 4:
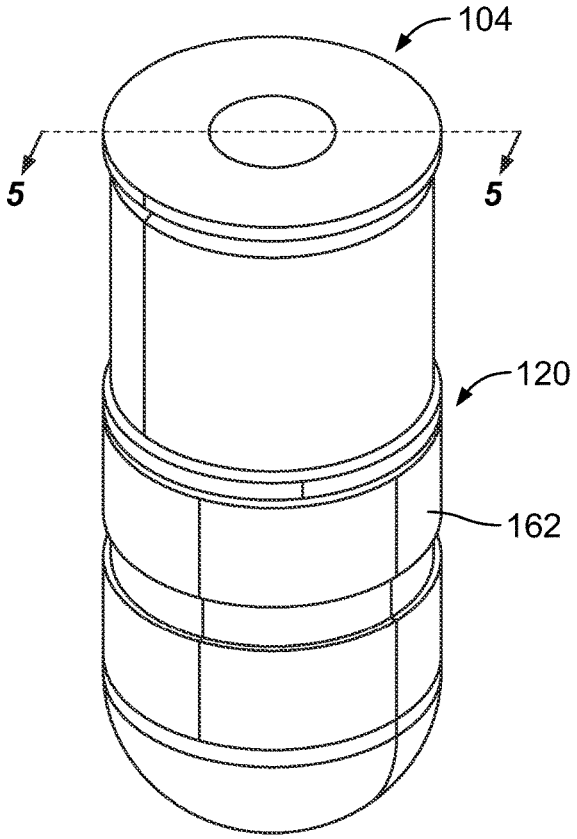
FIG. 4 illustrates a perspective view of a targeting munition, according to an embodiment of the present disclosure.
Figure 5:
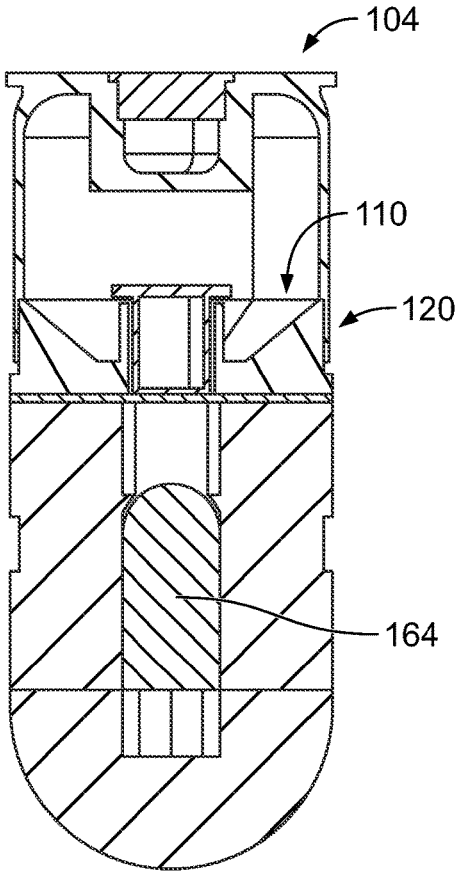
FIG. 5 illustrates a cross-sectional view of the targeting munition through line 5-5 of FIG. 4.
Figure 6:
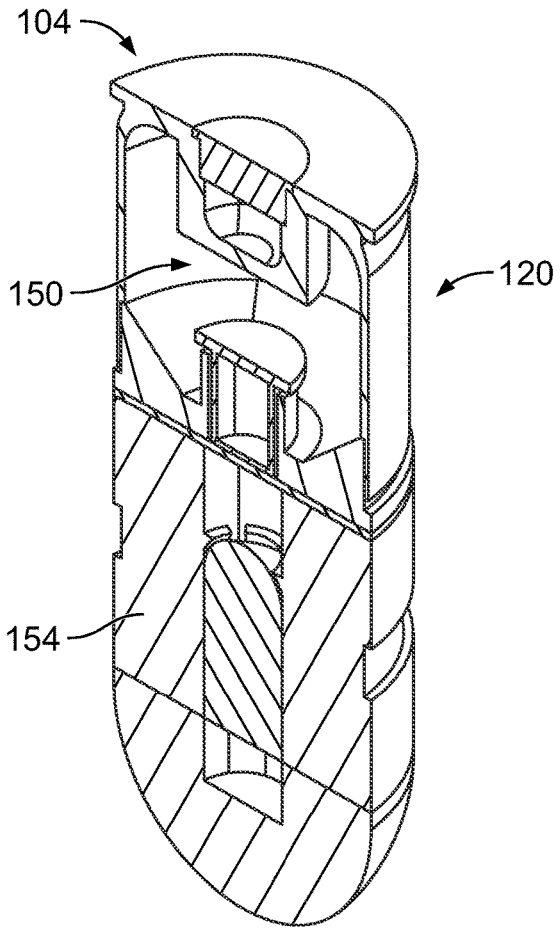
FIG. 6 illustrates a perspective internal view of the targeting munition.
Figure 7:
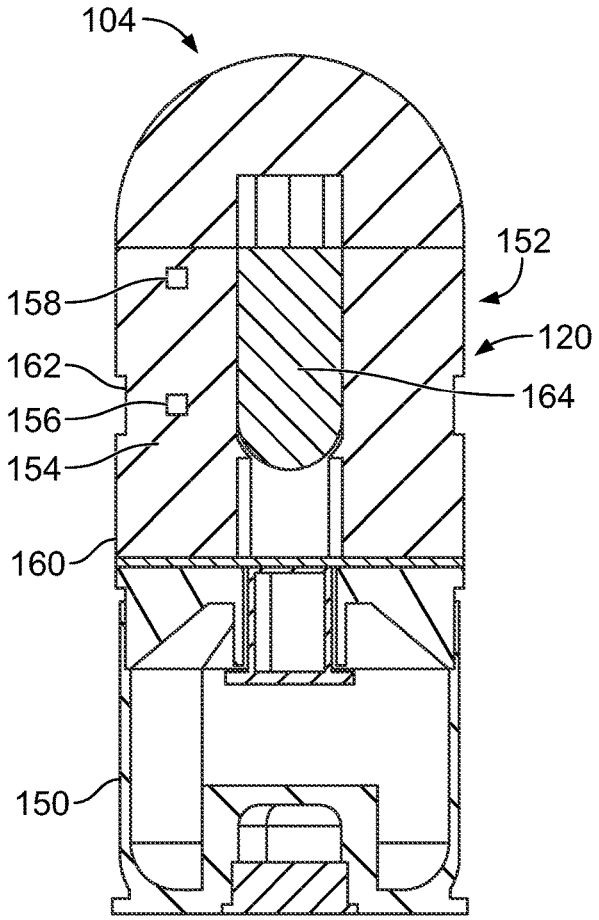
FIG. 7 illustrates a transverse cross-sectional view of the targeting munition.

FIG. 4 illustrates a perspective view of the targeting munition 104, according to an embodiment of the present disclosure. FIG. 5 illustrates a cross-sectional view of the targeting munition 104 through line 5-5 of FIG. 4. FIG. 6 illustrates a perspective internal view of the targeting munition 104. FIG. 7 illustrates a transverse cross-sectional view of the targeting munition 104. Referring to FIGS. 4-7, in at least one embodiment, the targeting munition 104 is configured as a 40 mm grenade. Optionally, the targeting munition 104 can be sized, shaped, and configured differently than shown.

In at least one embodiment, the targeting munition 104 includes a grenade 120 having a propulsion system 150. At least one shard, a battery, a diode, and a ballast are coupled to the grenade 120. An impact zone arming system and band cutter are also coupled to the grenade 120. A retention band is positioned around the shards. In at least one embodiment, the targeting munition 104 includes five shards. Optionally, the targeting munition 104 includes at least one shard, but more or less than five shards. As an example, the targeting munition 104 includes three shards. As another example, the targeting munition 104 includes ten shards. The increased amount of shards allows for more points of illumination. However, the points of illumination may be smaller. As such, a smaller number of shards can allow for larger points of illumination.

Referring to FIG. 7, in particular, in at least one embodiment, the targeting munition 104 is a 40 mm targeting grenade 120 including a propulsion system 150, and a payload 152 (such as an explosive portion) coupled to the propulsion system 150. The payload 152 includes a plurality of shards 154. In at least one embodiment, each shard 154 includes a battery 156, a laser diode 158, and a ballast 160. Each shard 154 is configured to emit targeting emissions at a predetermined frequency. Optionally, the targeting munition 104 does not include the propulsion system 150. Instead, the targeting munition 104 can be a hand-thrown grenade, for example. As another option, the targeting munition 104 can be propelled by a gun, slingshot, crossbow, or the like. As another option, the targeting munition 104 can be dropped from an aircraft.

In at least one embodiment, the payload 152 further includes a retention band 162 to retain the plurality of shards 154 prior to impact. A band cutter 164 is configured to sever the retention band 162 on impact.

Upon impact, each of the shards 154 is configured to eject at a predetermined distance. For example, the predetermined distance is approximately 1 to 3 meters. Optionally, the predetermined distance is less than 1 meter. As another option, the predetermined distance is greater than 3 meters. A smaller predetermined distance provides a more focused targeting area. However, a greater predetermined distance may be used for larger targeting areas.

In at least one embodiment, after ejection, at least one of the shards 154 is configured to land in an upright position such that the laser diode 158 emits toward the sky. For example, the shard 154 includes a base opposite from an end. The end includes the laser diode 158. The base has a weight that is substantially heavier than the end, thereby ensuring that the base is below the end, and the shard 154 is upright upon coming to rest on or near the target. The laser diode 158 therefore emits illumination toward the sky.

In at least one embodiment, example, the laser diode 158 is configured to emit infrared light. That is, the laser diode 158 is configured to illuminate within an infrared frequency.

Figure 8:
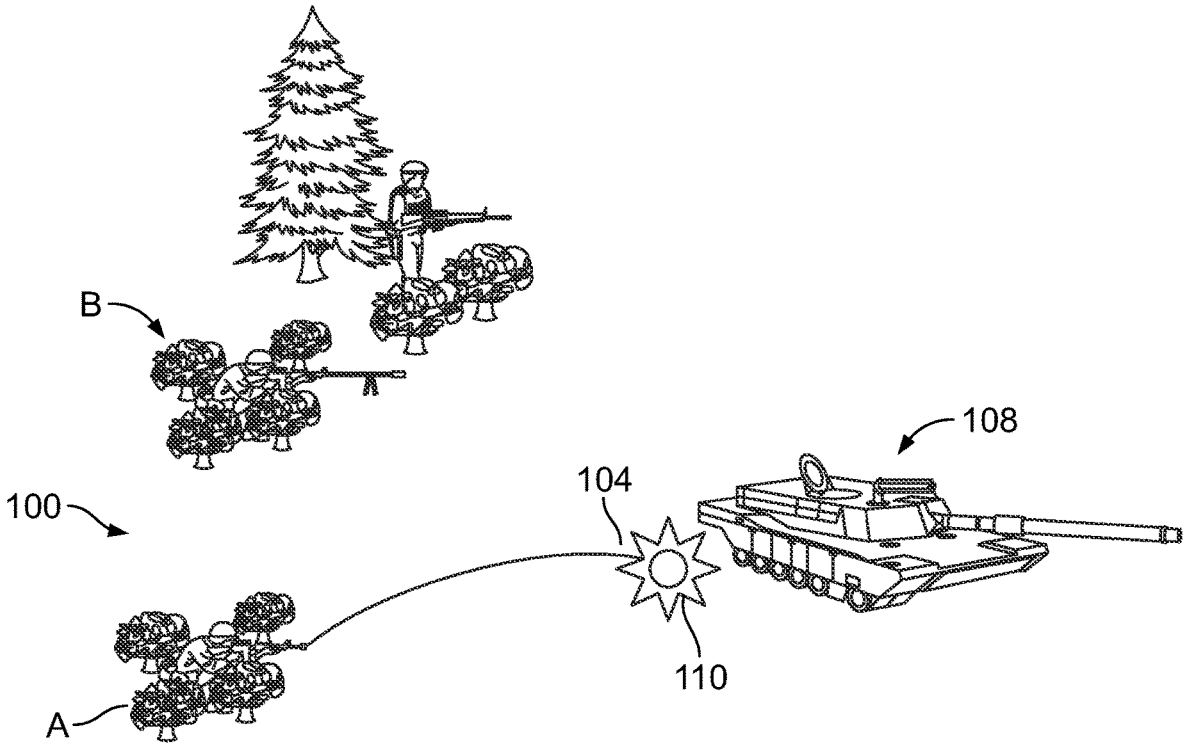
FIG. 8 illustrates a schematic diagram of the targeting system, according to an embodiment of the present disclosure.

FIG. 8 illustrates a schematic diagram of the targeting system 100, according to an embodiment of the present disclosure. In at least one embodiment, the targeting munition 104 is configured to provide point source illumination in the near IR spectrum visible to night vision and IR systems. The targeting munition 104 aides ground forces in maneuvering, indicating targets, illuminating areas under observation, identifying navigation hazards and illuminating preferred landing zones. In at least one embodiment, the targeting munition 104 does not include explosive components, and illuminates at a classified bandwidth supporting military and homeland security forces during operations.

As shown in FIG. 8, unit A fires the targeting munition 104 to the target 108. The targeting munition 104, upon impact, emits illumination, namely, the targeting emissions 110, such as IR suitable for night vision goggles (800-860 nm). As such, unit B sees illumination suitable for observation or engagement on the target.

In at least one embodiment, the targeting munition 104, upon impact, illuminates in a visible or a near visible IR and/or night vision frequency. The targeting munition 104 can be used to mark locations for maneuvering units, illuminate areas to aide detection of targets, illuminate vertical lift landing zones in ways that do not alert the adversary to the illumination, and/or the like.

In at least one embodiment, targeting munition 104 can be used as a targeting beacon that acts as a terminal guidance for laser munitions, for example. As an example, an operator can load a specific frequency into the targeting munition 104 to provide the terminal guidance. As another example, the targeting munition 104 provides a marking illumination (such as infrared illumination) of a longer duration than a typical flare, for example. For example, the laser diode can be programmed or otherwise switched between a pulsating emission (to be used for targeting, for example), or a continuous emission (to be used as illumination, for example).

In at least one embodiment, the targeting munition 104 is configured to designate a target with pulsed illuminating light at a predetermined frequency (such as input by an operator) that is visible to American IR and at least some night vision systems used by the US military and Allies. The targeting munition 104 uses the existing propellant and casement of fielded grenade system, but replaces the payload with a target designation round. In at least one embodiment, the round includes five shards, an impact fuse and a deployment spring. Adversaries will be unaware they are being illuminated. As another example, illumination can also be used to identify navigation hazards for vehicles, landing zones for helicopters and rally points for maneuvering forces.

The targeting system and method is targetable and can define a specific area of illumination instead of illuminating a broad area. Further, the targeting system and method provide ground illumination at the point of impact, whereas existing systems are overhead illuminators that can be disruptive to support aircraft. Additionally, the targeting system and method provide longer illumination (for example, five or more minutes) at the targeted area, whereas existing parachute flares last for approximately 6 seconds. The five shards provide five sources of light over the target area instead of one source of illumination, enabling diffuse illumination that does not saturate night vision or IR sensors. The target system and method does not pose the risk of secondary fire, and is not as noticeable (by adversaries) as an overhead parachute flare.

Figure 9:
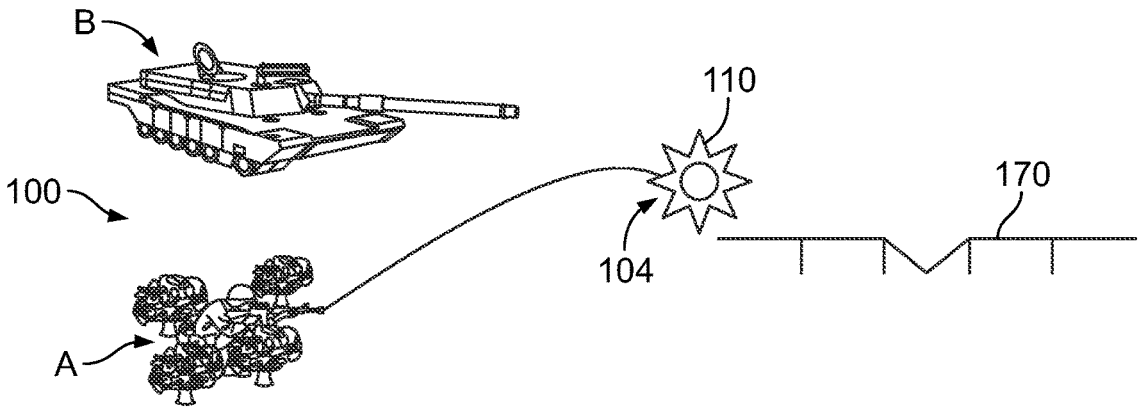
FIG. 9 illustrates a schematic diagram of the targeting system, according to an embodiment of the present disclosure.

FIG. 9 illustrates a schematic diagram of the targeting system 100, according to an embodiment of the present disclosure. As shown, the targeting munition 104 can be used to illuminate a hazard 170, such as a damaged bridge.

Figure 10:
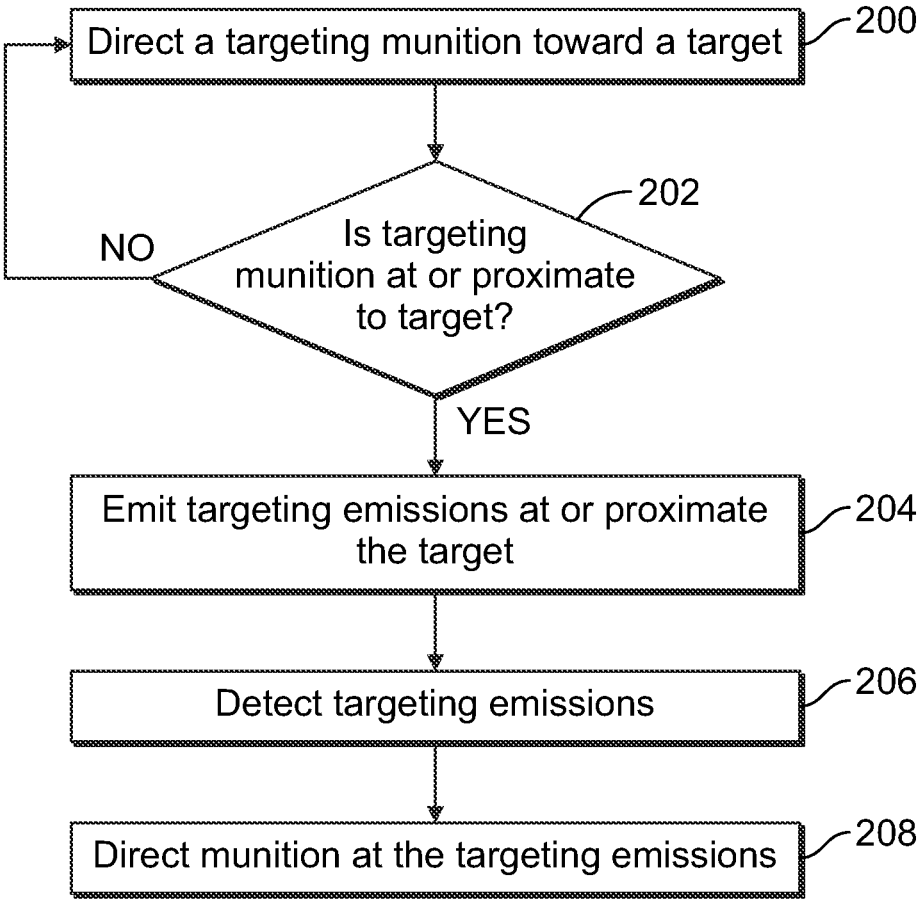
FIG. 10 illustrates a flow chart of a targeting method, according to an embodiment of the present disclosure.

FIG. 10 illustrates a flow chart of a targeting method, according to an embodiment of the present disclosure. Referring to FIGS. 1-10, the method begins at 200, at which a targeting munition 104 is directed toward a target 108. For example, an operator 102 can fire the targeting munition 104 at the target 108.

At 202, the operator 102 determines if the targeting munition 104 is at and/or proximate to the target 108. For example, the operator 102 determines if the targeting munition 104 is within a range of the target 108 at which further action (such as illuminating the target as a hazard, neutralizing the target 108 with munition 114 from a strike aircraft 112, and/or the like) will be effective. If the targeting munition 104 is not at or proximate to the target 108, the method returns to 200.

If, however, the targeting munition 104 impacts at or proximate to the target 108, the method proceeds to 204, at which targeting emissions 110 are emitted by the shards 154 at or proximate to the target 108. Accordingly, at 206, the targeting emissions 110 are detected, such as by the aircraft 112. In response, at 208. The aircraft 112 directs the munition(s) 114 at the targeting emissions 110.

In at least one embodiment, a targeting method includes directing the targeting munition 104 toward the target 108, and emitting the targeting emissions 110 from laser diodes 158 of a plurality of shards 154 ejected from the targeting munition 104 upon impact at or proximate to the target 108. In at least one example, said emitting includes emitting the targeting emission 110 (such as an illumination) at a predetermined frequency.

In at least one example, the targeting method also includes retaining the plurality of shards 154 within the targeting munition 104 prior to impact with the retention band 162. As a further example, the method includes severing the retention band 162 on impact with the band cutter 164.

In at least one example, the targeting method includes ejecting each of the plurality of shards 154 a predetermined distance upon impact of the target 108 by the targeting munition 104. For example, the predetermined distance is approximately 1 to 3 meters.

Further, the disclosure comprises embodiments according to the following clauses:

Clause 1. A targeting munition for a targeting system, the targeting munition comprising:

a payload including a plurality of shards, wherein at least one of the shards includes a laser diode configured to emit targeting emission in response to the targeting munition impacting an area at or proximate to a target.

Clause 2. The targeting munition of Clause 1, wherein each of the plurality of shards includes a laser diode.

Clause 3. The targeting munition of Clauses 1 or 2, wherein the laser diode is configured to emit the targeting emission at a predetermined frequency.

Clause 4. The targeting munition of any of Clauses 1-3, wherein the payload further comprises a battery and a ballast.

Clause 5. The targeting munition of any of Clauses 1-4, further comprising a propulsion system coupled to the payload.

Clause 6. The targeting munition of any of Clauses 1-5, wherein the targeting munition is a 40 mm targeting grenade.

Clause 7. The targeting munition of any of Clauses 1-6, wherein the payload further comprises a retention band to retain the plurality of shards prior to the targeting munition impacting the target.

Clause 8. The targeting munition of Clause 7, further comprising a band cutter configured to sever the retention band in response to the targeting munition impacting the target.

Clause 9. The targeting munition of any of Clauses 1-8, wherein each of the plurality of shards is configured to be ejected a predetermined distance in response to the targeting munition impacting the target.

Clause 10. The targeting munition of Clause 9, wherein the predetermined distance is approximately 1 to 3 meters.

Clause 11. The targeting munition of any of Clauses 1-10, wherein the plurality of shards comprises five shards.

Clause 12. The targeting munition of any of Clauses 1-11, wherein at least one of the plurality of shards is configured to land in an upright position such that the laser diode emits the targeting emission toward the sky.

Clause 13. A targeting method comprising:

directing a targeting munition toward a target; and emitting targeting emissions from laser diodes of a plurality of shards ejected from the targeting munition upon impact of the targeting munition at or proximate to the target.

Clause 14. The targeting method of Clause 13, wherein said emitting comprises emitting the targeting emission at a predetermined frequency.

Clause 15. The targeting method of Clauses 13 or 14, further comprising retaining the plurality of shards within the targeting munition prior to impact with a retention band.

Clause 16. The targeting method of Clause 15, further comprising severing the retention band on impact with a band cutter.

Clause 17. The targeting method of any of Clauses 13-16, further comprising ejecting each of the plurality of shards a predetermined distance upon impact of the target targeting munition by the targeting munition.

Clause 18. The targeting method of Clause 17, wherein the predetermined distance is approximately 1 to 3 meters.

Clause 19. The targeting method of any of Clauses 13-18, wherein the plurality of shards comprises five shards.

Clause 20. A targeting munition for a targeting system, the targeting munition comprising:

a propulsion system; and a payload coupled to the propulsion system, wherein the payload comprises:

a battery;

a ballast;

a plurality of shards, wherein each of the plurality of shards includes a laser diode configured to emit targeting emission at a predetermined frequency in response to the targeting munition impacting an area at or proximate to a target, and wherein each of the plurality of shards is configured to be ejected a predetermined distance in response to the targeting munition impacting the target;

a retention band to retain the plurality of shards prior to the targeting munition impacting the target; and a band cutter configured to sever the retention band in response to the targeting munition impacting the target.

As described herein, embodiments of the present disclosure provide targeting systems and methods that do not require multiple aircraft to drop a single bomb. Further, the targeting systems and methods do not require a ground fire coordinator to maintain a targeting emission on a target. Further, the targeting systems and methods minimize or otherwise reduce aircraft exposure to ground fire while the aircraft drops munitions on a target.

While various spatial and directional terms, such as top, bottom, lower, mid, lateral, horizontal, vertical, front and the like can be used to describe embodiments of the present disclosure, it is understood that such terms are merely used with respect to the orientations shown in the drawings. The orientations can be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims and the detailed description herein, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and can include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A targeting munition for a targeting system, the targeting munition comprising:

a payload including:

a plurality of shards, wherein at least one of the shards includes a laser diode configured to emit targeting emission in response to the targeting munition impacting an area at or proximate to a target;

a retention band to retain the plurality of shards prior to the targeting munition impacting the target; and a band cutter configured to sever the retention band in response to the targeting munition impacting the target, wherein the band cutter is disposed inside of the retention band such that the retention band extends around at least a portion of the band cutter.

2. The targeting munition of claim 1, wherein each of the plurality of shards includes a laser diode.

3. The targeting munition of claim 1, wherein the laser diode is configured to emit the targeting emission at a predetermined frequency.

4. The targeting munition of claim 1, wherein the payload further comprises a battery and a ballast.

5. The targeting munition of claim 1, further comprising a propulsion system coupled to the payload.

6. The targeting munition of claim 1, wherein the targeting munition is a 40 mm targeting grenade.

7. The targeting munition of claim 1, wherein each of the plurality of shards is configured to be ejected a predetermined distance in response to the targeting munition impacting the target.

8. The targeting munition of claim 7, wherein the predetermined distance is approximately 1 to 3 meters.

9. The targeting munition of claim 1, wherein the plurality of shards comprises five shards.

10. The targeting munition of claim 1, wherein at least one of the plurality of shards is configured to land in an upright position such that the laser diode emits the targeting emission toward the sky.

11. The targeting munition of claim 1, wherein the targeting munition is configured to be deployed from a handheld grenade launcher.

12. The targeting munition of claim 1, wherein the targeting emission is infrared light.

13. A targeting method comprising:

retaining a plurality of shards within a targeting munition prior to impact with a retention band;

directing the targeting munition toward a target;

severing the retention band on impact at or proximate to the target with a band cutter disposed inside of the retention band such that the retention band extends around at least a portion of the band cutter before the impact; and emitting targeting emissions from laser diodes of the plurality of shards ejected from the targeting munition upon the impact of the targeting munition at or proximate to the target.

14. The targeting method of claim 13, wherein said emitting comprises emitting the targeting emission at a predetermined frequency.

15. The targeting method of claim 13, further comprising ejecting each of the plurality of shards a predetermined distance upon impact of the target targeting munition by the targeting munition.

16. The targeting method of claim 15, wherein the predetermined distance is approximately 1 to 3 meters.

17. The targeting method of claim 13, wherein the plurality of shards comprises five shards.

18. The targeting method of claim 13, wherein said directing comprises deploying the targeting munition from a handheld grenade launcher.

19. A targeting munition for a targeting system, the targeting munition comprising:

a propulsion system; and a payload coupled to the propulsion system, wherein the payload comprises:

a battery;

a ballast;

a plurality of shards, wherein each of the plurality of shards includes a laser diode configured to emit targeting emission at a predetermined frequency in response to the targeting munition impacting an area at or proximate to a target, and wherein each of the plurality of shards is configured to be ejected a predetermined distance in response to the targeting munition impacting the target;

a retention band to retain the plurality of shards prior to the targeting munition impacting the target; and a band cutter configured to sever the retention band in response to the targeting munition impacting the target, wherein the band cutter is disposed inside of the retention band such that the retention band extends around at least a portion of the band cutter.

20. The targeting munition of claim 19, wherein the targeting munition is configured to be deployed from a handheld grenade launcher, and wherein the targeting emission is infrared light.

* * * * *